US005291017A

United States Patent [19]

Wang et al.

[11] Patent Number: 5,291,017

[45] Date of Patent: Mar. 1, 1994

[54] ION TRAP MASS SPECTROMETER METHOD AND APPARATUS FOR IMPROVED SENSITIVITY

[75] Inventors: Mingda Wang, Walnut Creek; Edward G. Marquette, Oakland, both of Calif.

[73] Assignee: Varian Associates, Inc., Palo Alto, Calif.

[21] Appl. No.: 9,604

[22] Filed: Jan. 27, 1993

[51] Int. Cl.[5] ..... H01V 49/42

[52] U.S. Cl. ..... 250/292; 250/282

[58] Field of Search ..... 250/292, 291, 290, 282

[56] References Cited

U.S. PATENT DOCUMENTS 3,527,939 9/1970 Dawson et al. ..... 250/292

4,882,484 11/1989 Franzen et al. ..... 250/282

5,206,509 4/1993 McLuckey et al. ..... 250/292

FOREIGN PATENT DOCUMENTS 4017264 12/1991 Fed. Rep. of Germany .

OTHER PUBLICATIONS

Franzen, J. "Simulation Study of an Ion Cage with Superimposed Multipole Fields," *International Journal of Mass Spectrometry and Ion Processes,* 106 (1991) 63–78.

*Primary Examiner*—Jack I. Berman

*Attorney, Agent, or Firm*—Gerald M. Fisher

[57] ABSTRACT

An ion trap mass spectrometer system providing superposition of an AC dipole and/or monopole field on the quadrupole field to provide one preferential ejection direction.

25 Claims, 8 Drawing Sheets

ION TRAP MASS SPECTROMETER METHOD AND APPARATUS FOR IMPROVED SENSITIVITY

FIELD OF THE INVENTION

This invention relates to methods and apparatus for improving collection sensitivity of ions of interest in a ion trap mass spectrometer.

BACKGROUND OF THE INVENTION

Mass spectrometers enable precise determinations of the constituents of a material. There are several distinctly different types of mass spectrometers. They all provide separations of all the different masses in a sample according to its mass to charge ratio. The molecules of the sample · are disassociated/fragmented into charged atoms or groups of atoms, i.e. ions, and the ions are introduced into a region where they are acted upon by magnetic or electric fields which can be manipulated to separate the ions because the forces on the ions depend upon their mass to charge ratio.

The quadrupole mass spectrometer is one form of spectrometer device which does not employ magnets but utilizes radio frequency and/or DC fields in conjunction with a specifically shaped electrode structure. Inside the structure, the RF fields are shaped so that they can interact with certain ions causing a restoring force to induce such ions to oscillate about an electrically neutral position. A form of the quadrupole known as the quadrupole ion trap (QIT) has become important in recent years as a result of the development of more convenient techniques for handling the ions. The QIT device enables restoring forces in all three directions and can actually trap ions of selected mass/charge ratio inside the structure. The ions so trapped are capable of being retained for long periods of time which enables and supports various experiments which are not convenient in other apparatus.

In the use of a QIT, ions are usually confined by the RF field and then sequentially ejected to a detector by either ramping the RF trapping field voltage applied to the ring electrode or by applying a supplemental secular resonance frequency excitation to the end caps or applying a scan and a supplemental field simultaneously.

Another application of the QIT is in the so called MS/MS mode where a range of masses are trapped; mass scanning and/or resonance ejection employed to confine particularly chosen ions; then, disassociating the parent ions by collisions and separating/ejecting the fragments and obtaining a mass spectrum of the daughter ions.

When ejecting ions from the trap to the detector, in most prior art apparatus, equal percentages of ions were ejected toward both end caps. Since the ion detector was installed in only one end cap, the sensitivity was not maximized.

In U.S. Pat. No. 4,882,484, an apparatus and technique is disclosed and described for compressing the path of oscillations of ions in a trap so that the ions which impact the end cap are focussed toward the center of the end cap. This patent claimed a significant sensitivity improvement. This '484 patent also recognized that it would be beneficial to impact the ions on the correct end cap containing the detector. To accomplish this result, it is proposed to introduce a third order field non-linearity by shaping the ring and the end caps or to apply a small static DC voltage between the end caps. This '484 patent also describes static superimposition of higher order field distortions made possible by changing the shapes of the electrodes from a pure hyperbolic. German Patent No. DE4017264A1 and the journal article at Int. J. Mass Spectroscopy and Ion Process, Vol. 106, 1991, p. 63–78, also describe superimposition of multipole fields as a means to improve sensitivity.

The creation of special complicated surfaces as described by DE4017264A1 and U.S. Pat. No. 4,882,484 is very expensive and difficult. Also, due to the requirements for non-linear resonance, only certain selected ejection excitation frequencies are possible, such as $\frac{1}{3}$ RF trapping field frequency in a hexapole field. Another disadvantage is that the relative magnitude of the quadrupole and hexapole or octapole field is fixed for a given set of shaped electrodes. The use of a small DC bias voltage applied to the end caps provides a superimposed static dipole field across the QIT. For small values of DC bias, no significant preferential effect in intensity is seen. For larger values of DC bias, intensity of larger mass ions is reduced. In addition, the application of a DC dipole field will cause the mass calibration curve for the trap to become nonlinear.

SUMMARY OF THE INVENTION

It is an object of this invention to improve the sensitivity of an ion trap mass spectrometer by providing a method and apparatus for selectively ejecting ions at one end cap while retaining a linear mass calibration.

It is a further object to focus most ejected ions on one end cap without requiring complex third order or higher order shaping or machining of the trap electrodes.

It is a further object to enable or disable ion ejection towards one end cap at selected times.

It is a feature to enable an inexpensive and simple, tunable, unbalanced ion trap employing unequal lumped parameter impedances in circuit with the end caps which permits operation with supplemental ejection oscillators.

GENERAL DESCRIPTION OF THE INVENTION

Figure 1A:
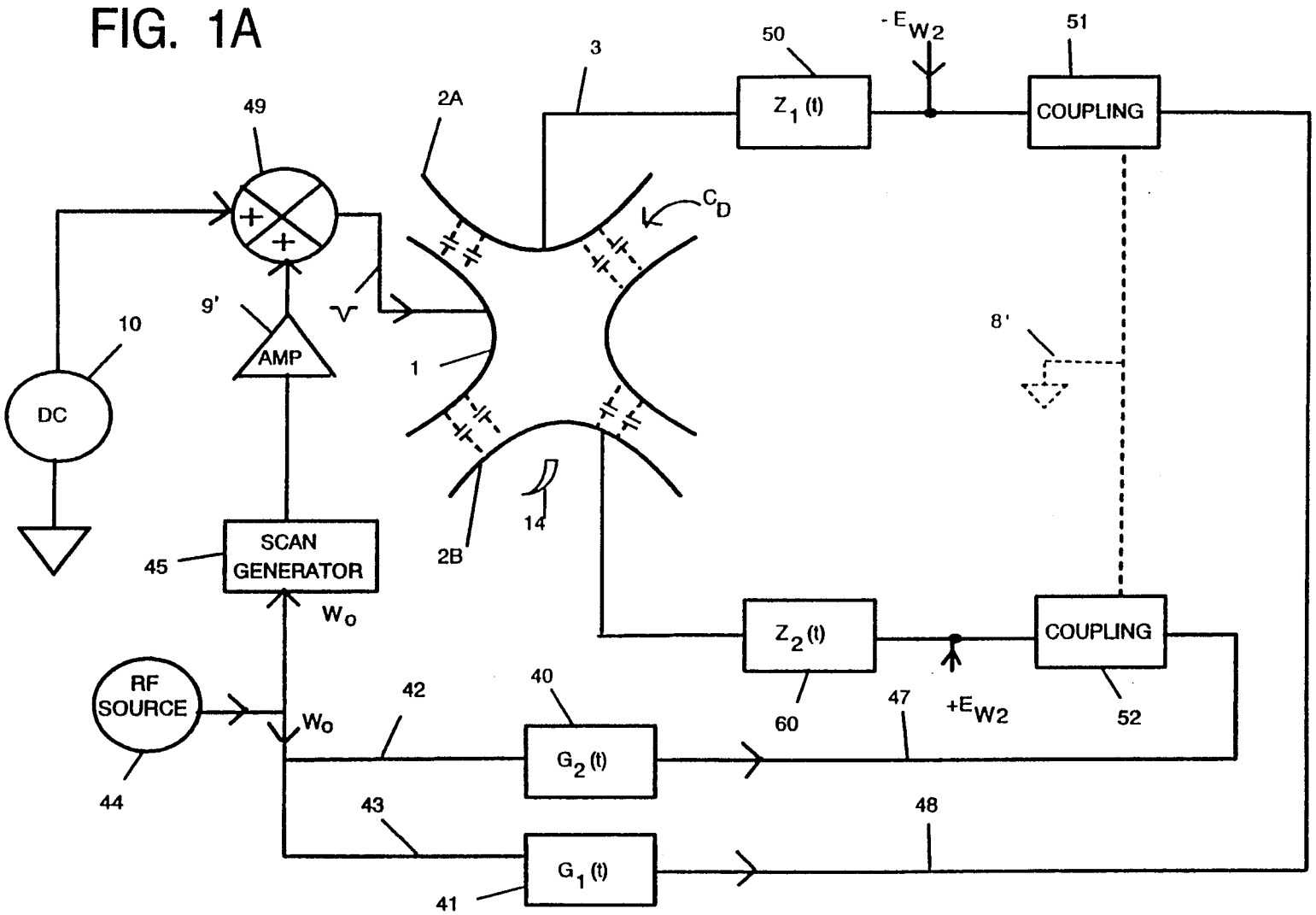
FIG. 1A is a general schematic of the inventive QIT.

With reference to FIG. 1A, the QIT is shown schematically composed of ring electrode 1, upper end cap 2A and lower end cap 2B. Ion detector/electron multiplier 14 is shown below end cap 2B. The end cap 2B has a centrally located perforation therethrough (not shown) for passing ions to the detector 14.

In operation, ions are injected into the trap or created in the trap by introducing sample atoms into the trap and ionizing them in the trap by standard known techniques, not shown. The RF trapping voltage, V, at frequency, $W_0$ and DC voltage U, is applied to the trap and because of the shape of the electrode 1 and end caps 2A and 2B, a restoring force is created which traps certain ions according to the well known relationship between the trap parameters $a_z$ and $q_z$ and the amplitude and frequency of V and U as determined by the equations.

Depending on how the potentials are applied to the end caps and on the relationship of the distances $z_o$ and $r_o$, the minimum distances between end caps and ring electrodes respectively, the equation defining the trap stability diagram are different but have the same form and slightly different constants.

Figure 1B:
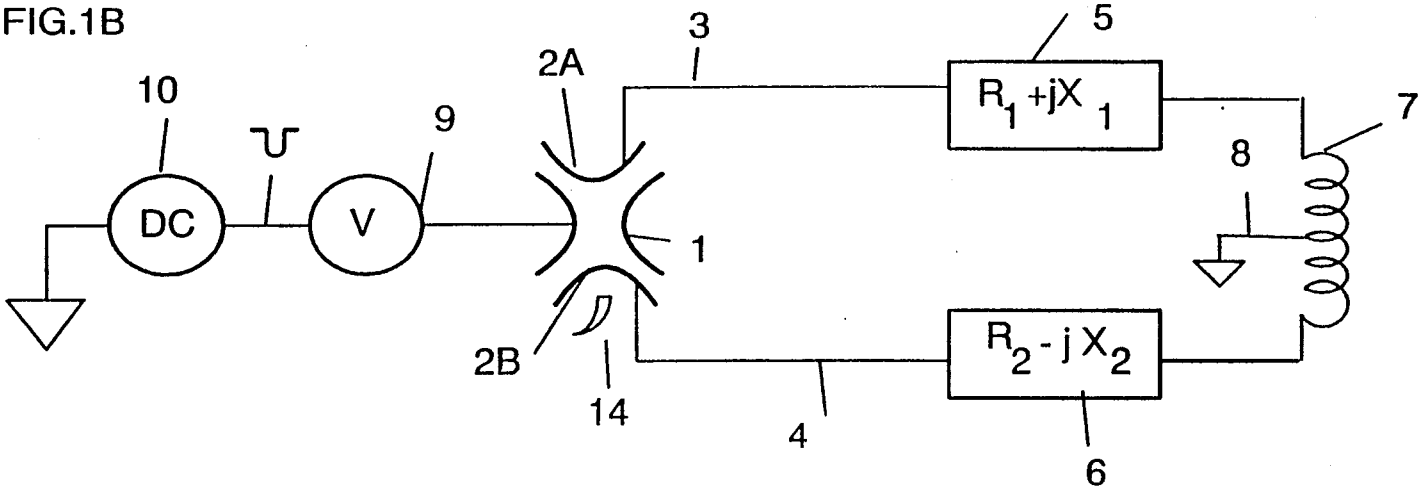
FIG. 1B is a block diagram of the preferred embodiment of this invention showing unbalanced lumped tuning impedance elements connected to the end caps.

Per March and Hughes, *Quadrupole Storage Mass Spectroscopy*, Wiley & Sons (1989), p. 62, the stability parameters for FIG. 1B are:

$$a_r = keU/mr_0^2\omega_0^2 \text{ and } q_r = \frac{k}{2}\, eV/mr_0^2 \qquad (1)$$

where $a_z = -2a_r$ and $q_z = -2q_r$ where U is DC potential and V is amplitude of AC potential, $\omega_0$ is angular frequency of RF field, k is constant, m is mass and e is charge.

We have discovered that if we apply an ac dipole and/or monopole voltage to the end caps 2A and 2B of the same frequency $\omega_0$ as the RF trapping voltage applied to the ring 1, we can cause the negative and positive ions to be preferentially ejected to one of the end caps. Our data shows approximately 4:1 selectivity for the ions to be ejected to one of the end caps.

Our technique can be implemented, with reference to FIG. 1A, by deriving both the end cap voltages and RF trapping frequency $\omega_0$ applied to ring electrode 1 from a common RF source 44 applied to the scan generator 45 which scans/changes the voltage V as a function of time. Schematically, the output of the scan generator 45 is connected to summer 49 for adding the DC and AC amplifier 9' and then the voltage output of amplifier 9' is the RF trapping voltage V in the equation shown above.

One path for applying an AC dipole or/and monopole voltage to the end caps is to derive signals to be fed to the end caps 2A and 2B from the same RF source 44 and to treat the signal by different transfer functions, $G_2(t)$ and G(t), through coupling 52 and 51, then through the impedances $Z_2(t)$ and $Z_1(t)$ respectively to end cap 2B and 2A. If $G_2(t) = -G_1(t)$, and $Z_1$ and $Z_2$ are negligibly small, then the voltage applied to caps 2A and 2B are equal in amplitude and 180° out of phase. This creates the so called dipole field. If either $$\left.\begin{matrix} G_1(t) = 0 \\ G_2(t) \neq 0 \end{matrix}\right\} \text{or} \left\{\begin{matrix} G_1(t) \neq 0 \\ G_2(t) = 0 \end{matrix}\right.$$

then the applied field is called a monopole field.

It can be shown that when the voltage along the Z axis in the trap has a dipole and/or monopole field component it has the form $$v_z = A\cos(W_0t+\theta_0) + Bz\cos(W_0t+\theta_1) + Cz^2\cos(W_0t+\theta_2) + \ldots \qquad (2)$$

where A is the monopole term coefficient, B is the dipole term coefficient and C is the quadrupole term coefficient.

When $G_1 = G_2$ and $Z_1 = Z_2 = 0$, then $A = B = 0$ and $C \neq 0$, a pure quadrupole field exists.

For the condition where $G_1 \neq G_2$ and $G_1, G_2 \neq 0$, and $G_1$ and $G_2$ are of opposite phase, then both monopole field and dipole fields are present, i.e., $A \neq 0$, $B \neq 0$. For the condition $$\begin{cases} G_1 = G_2 = 0 \\ Z_1 = -Z_2 \end{cases}$$

it can be shown that due to the distributed capacitive coupling $C_D$ between the ring electrode 1 and the end caps 2A and 2B, an AC dipole field will be induced in the QIT because the identical currents in the two impedances 50 and 60 create equal and opposite voltage on each end cap with respect to ground. For the condition $G_1 = G_2 = 0$ and $|Z_1| \neq |Z_2|$, it can be shown that said capacitive coupling will create a monopole field. These above techniques may be combined to provide arbitrary combinations of monopole and dipole fields.

For general applicability, voltages $-E_{W2}$ and $+E_{W2}$ are shown connected in the path between impedance 50 and coupling 51 and impedance 60 and coupling 52 respectively. The voltage $E_{W2}$ stands for the known supplemental excitation frequency $W_2$ for ejection of ions which is described more fully in conjunction with FIG. 1C and FIG. 1D.

The $G_1(t)$ and $G_2(t)$ transfer functions also indicate that they can be non-constant functions of time which, when combined with the $\omega_0$ reference signal, provide beneficial sensitivity/intensity improvement. Likewise, $Z_1$ and $Z_2$ may be non-constant functions of time to provide said improvement. In particular, we can obtain improved results in so called MS/MS QIT spectrometer experiments by switching the dipole/monopole field off during ionization and on during ejection. Normal collision induced disassociation CID employed in MS/MS is or can be a very gentle excitation. It is better not to modify the trap fields from the nearly pure quadrupole field for repeatable CID. However, the dipole/-monopole provides significantly improved ion detection intensity so we provide for switching on the lower order fields. During CID, set $$\begin{cases} G_1 = G_2 = 0 \\ Z_1 = Z_2 = 0 \end{cases}$$

and during ion detection, set $$\begin{cases} G_1 \neq 0 \\ G_2 \neq 0 \end{cases} \text{or} \begin{cases} Z_1 \neq 0 \\ Z_2 \neq 0 \\ Z_1 \neq Z_2 \end{cases}$$

Lower order fields can also be induced in the QIT in a mechanical manner by positioning the end caps non-symmetrically with respect to the ring electrode. In the configuration of FIG. 1B, this would more efficiently couple the ring voltage to the closer end cap and if $|R_1+jX_1| \neq |R_2+jX_2|$, then an unbalanced voltage appears across the end caps resulting in non-zero coefficients A and B in equation (2) above.

DETAILED DESCRIPTION OF THIS INVENTION

With reference to FIG. 1B, we shown the preferred circuit to implement our invention.

By tuning the impedances 5 and 6 so that the impedance from end cap 2A to common ground 8 is different than the impedance from end cap 2B to common ground, and making use of the finite capacitance from ring electrode to end caps, an AC dipole and/or monopole field can be created at the frequency of the trapping field. This could be expressed as the superimposition of a dipole and/or monopole field on the quadrupole field. This distorts the symmetry of the quadrupole field from the z=o field so that trapped ions preferentially exit in the direction of the electron detector 14.

Figure 1C:
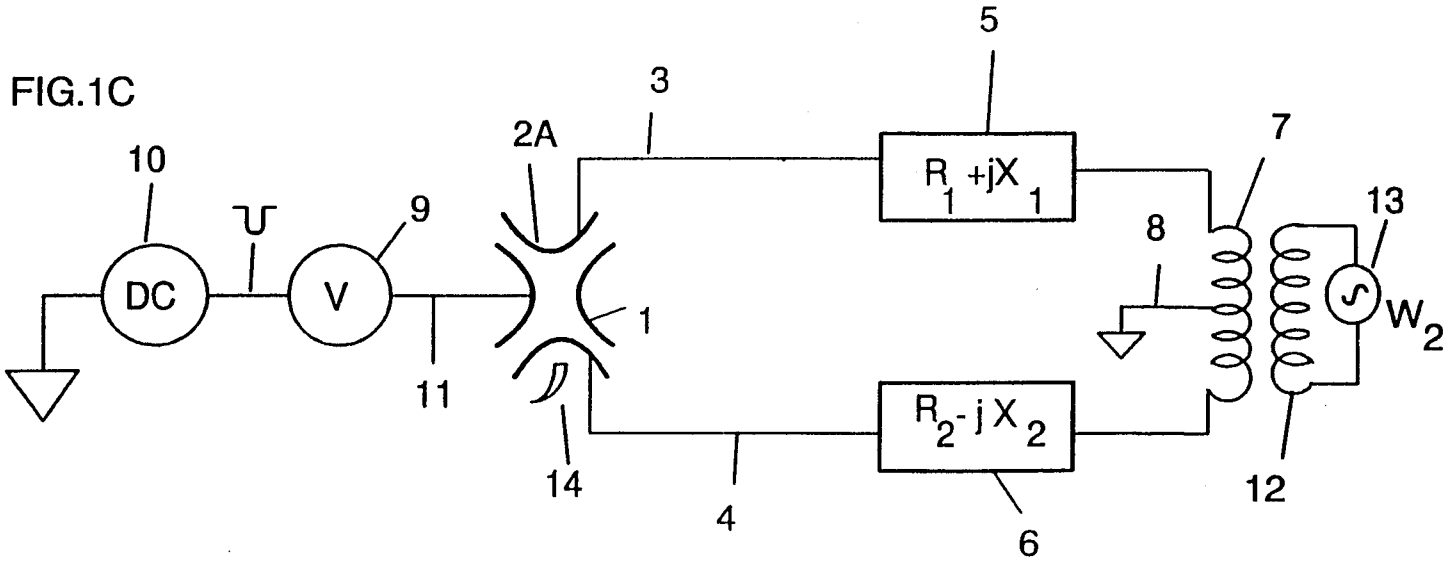
FIG. 1C is a block diagram showing the addition of the usual supplementary excitation oscillator to the end caps of FIG. 1A.
Figure 1D:
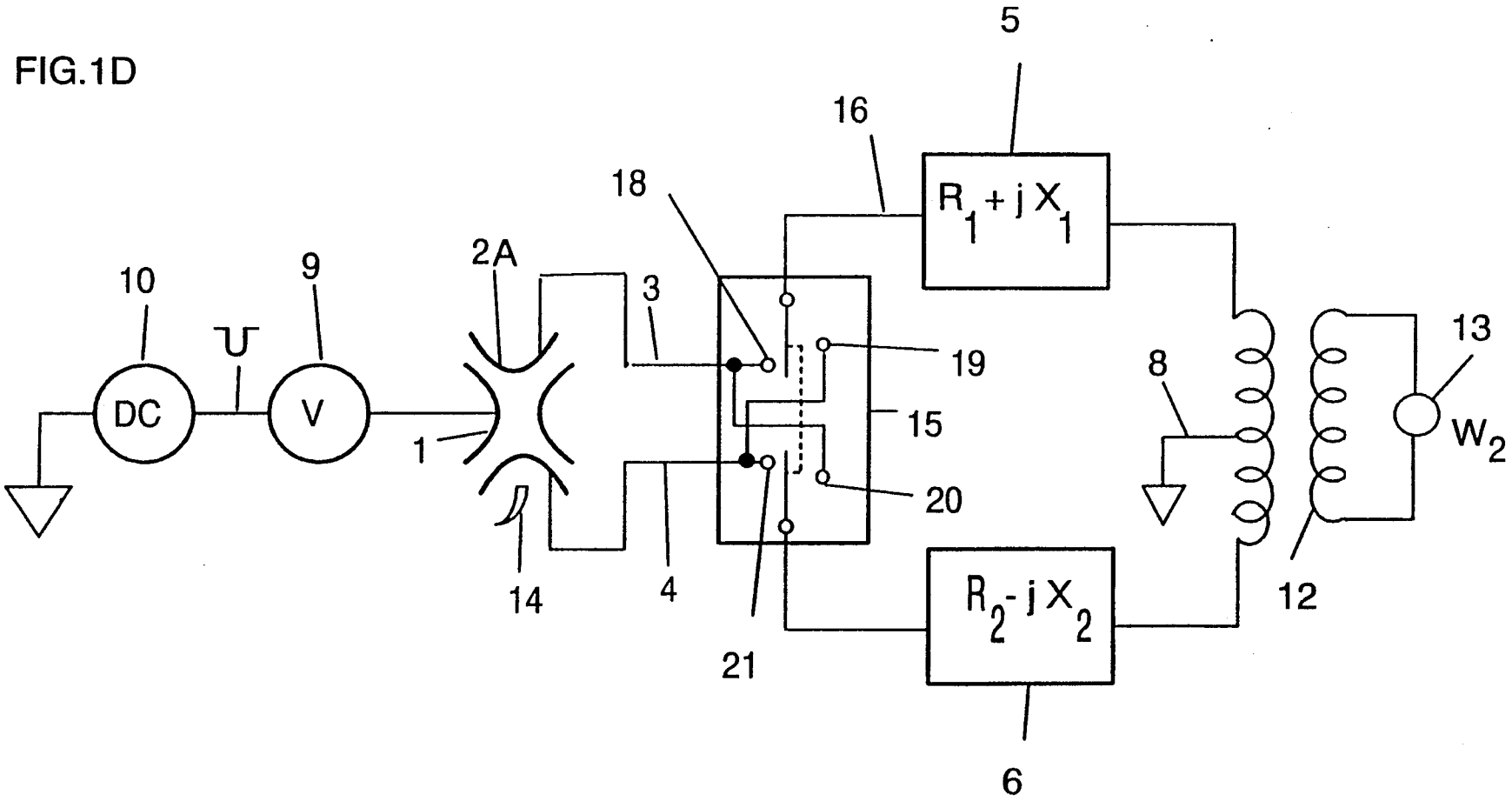
FIG. 1D is a block diagram showing the inclusion of a reversal switch for selecting opposite polarity ions.

As shown in FIG. 1C, the unbalanced impedances 5 and 6 do not preclude application of a secular ejection waveform from the supplementary ejection frequency generator 13 at frequency $W_2$ coupled through transformer winding 12 to center tapped winding 7. Currently the preferred frequency $W_2$ of frequency generator 13 is at 485 KHz for an RF trapping field frequency $W_0$ of 1.05 MHz. Negative and positive ions preferentially exit in opposite directions from the trap.

Figure 2:
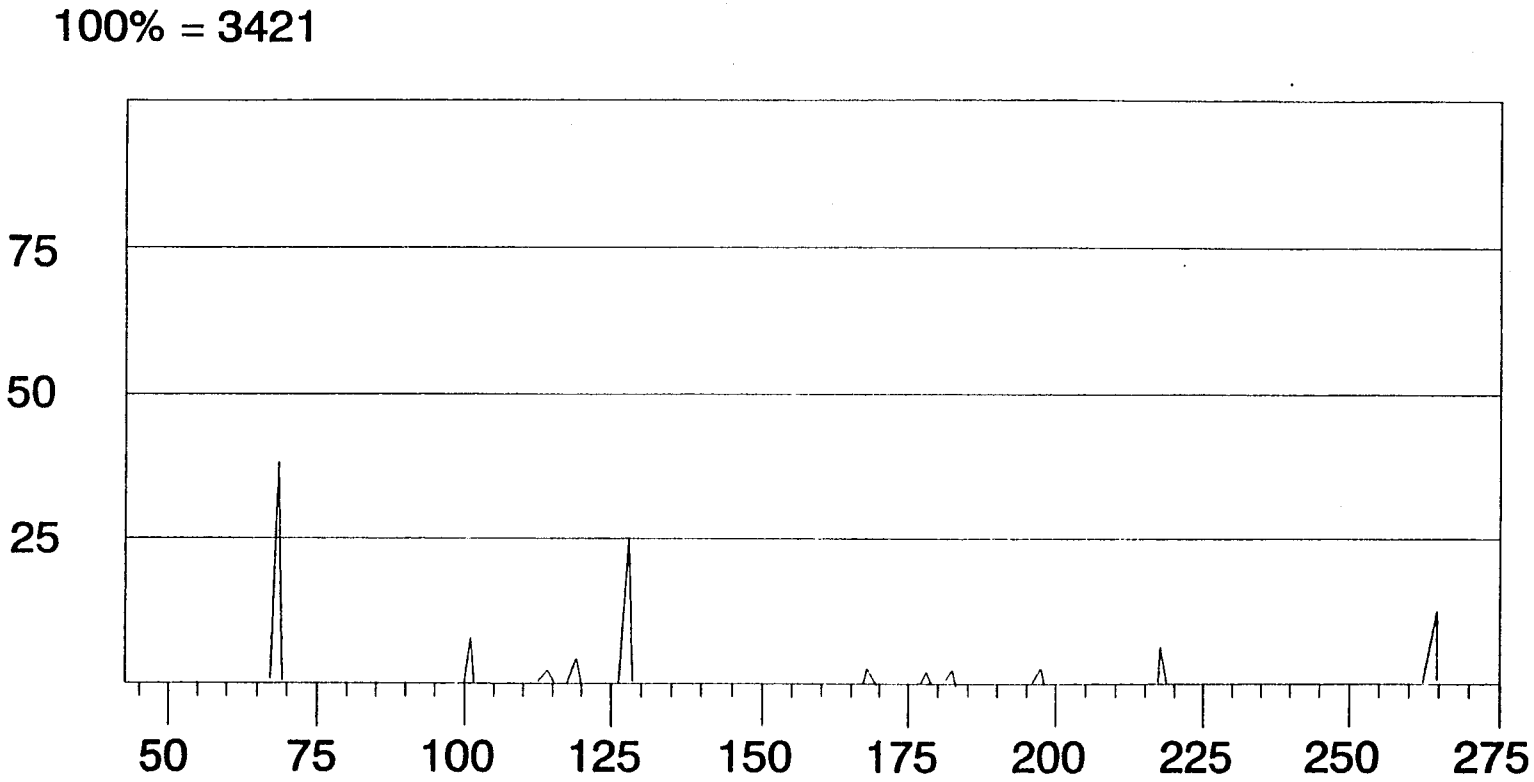
FIG. 2 is a spectrum of Perfluorotributylamine PFTBA in a prior art Varian QIT without any non-linear field imposition.
Figure 3:
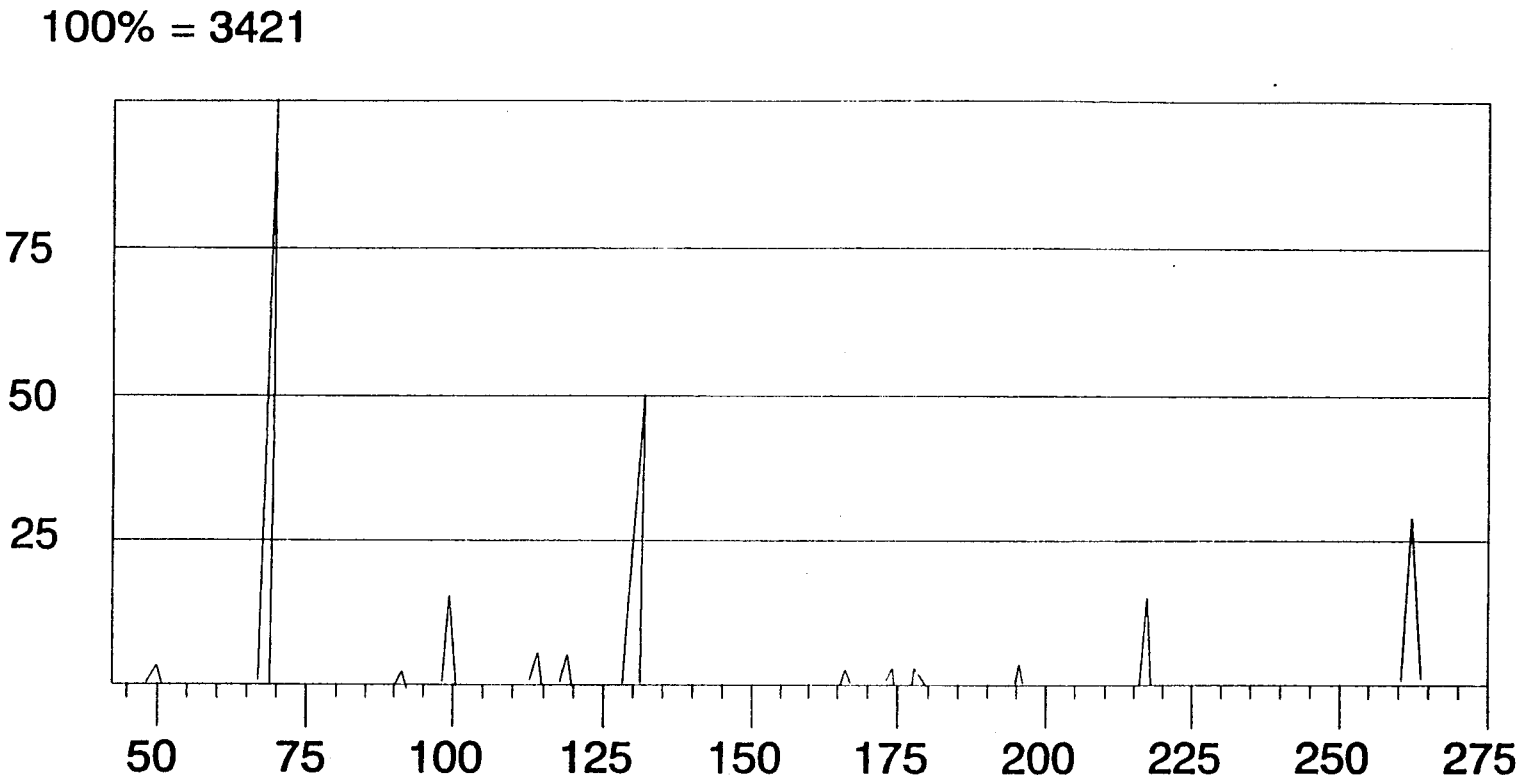
FIG. 3 is a spectrum of PFTBA in the same Varian QIT with the same parameters as FIG. 2 except for the superposition of the AC dipole field of this invention.
Figure 4:
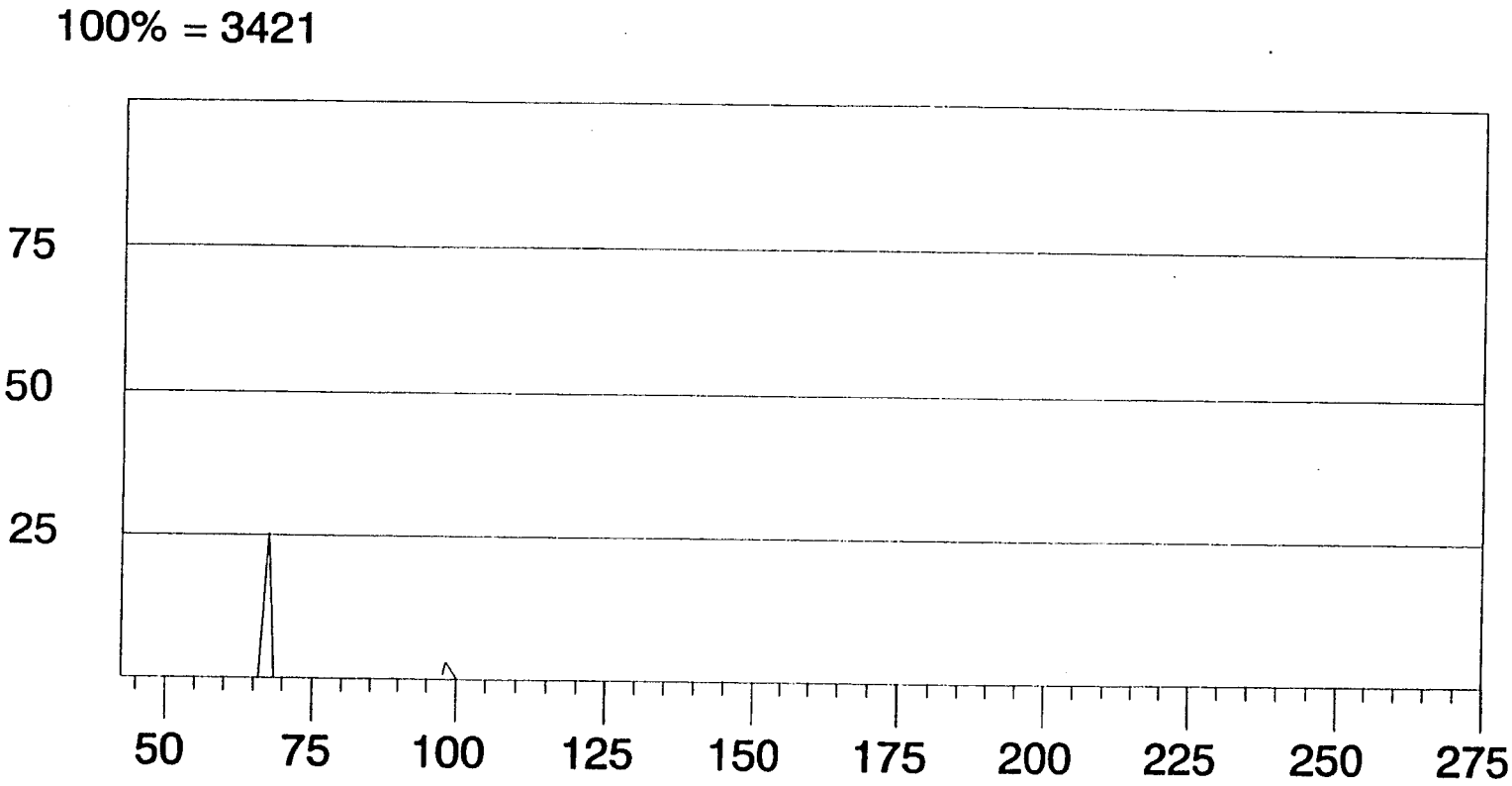
FIG. 4 is a spectrum of PTFBA in the same Varian QIT with the same parameters as FIG. 3 except for reversed dipole field superposition.

FIG. 2 is a spectrum of the standard test chemical, called PFTBA, acquired with the prior art Varian Saturn QIT spectrometer under standard operating conditions employing a fixed frequency $\omega_2$ supplementary generation 13 at 485 KHz. The spectrum obtained with PFTBA, and the same instrument and settings is shown in FIG. 3, where the impedance imbalance creating an AC dipole field of this invention is employed. The signal intensity is seen to be doubled as compared to FIG. 2. For the same conditions, FIG. 4 shows the spectrum of PFTBA with the double pole double throw switch 15 of FIG. 1D in the inverse position so that the ions of the opposite polarity are preferentially detected. Note that at several mass values in FIG. 4, no perceived opposite polarity ions are detected. For all experiments, the 100% intensity was set at an analog to digital converter ADC setting of 3421, and the scale is linear.

Figure 5A:
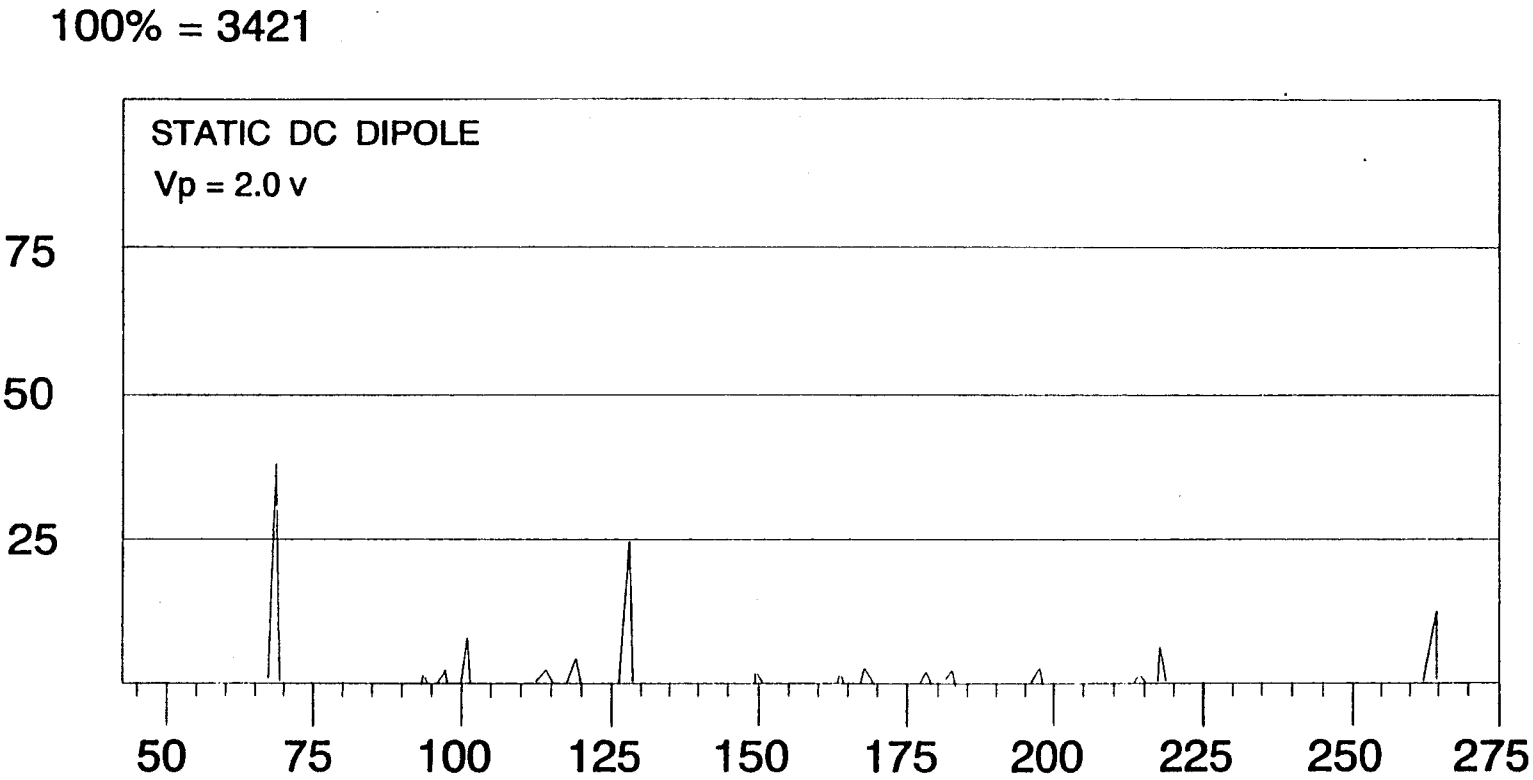
FIG. 5A is a spectrum of PTFBA in a Varian QIT without AC dipole field superposition but with a DC voltage applied to the end cap equal to 2.0 volts.
Figure 5B:
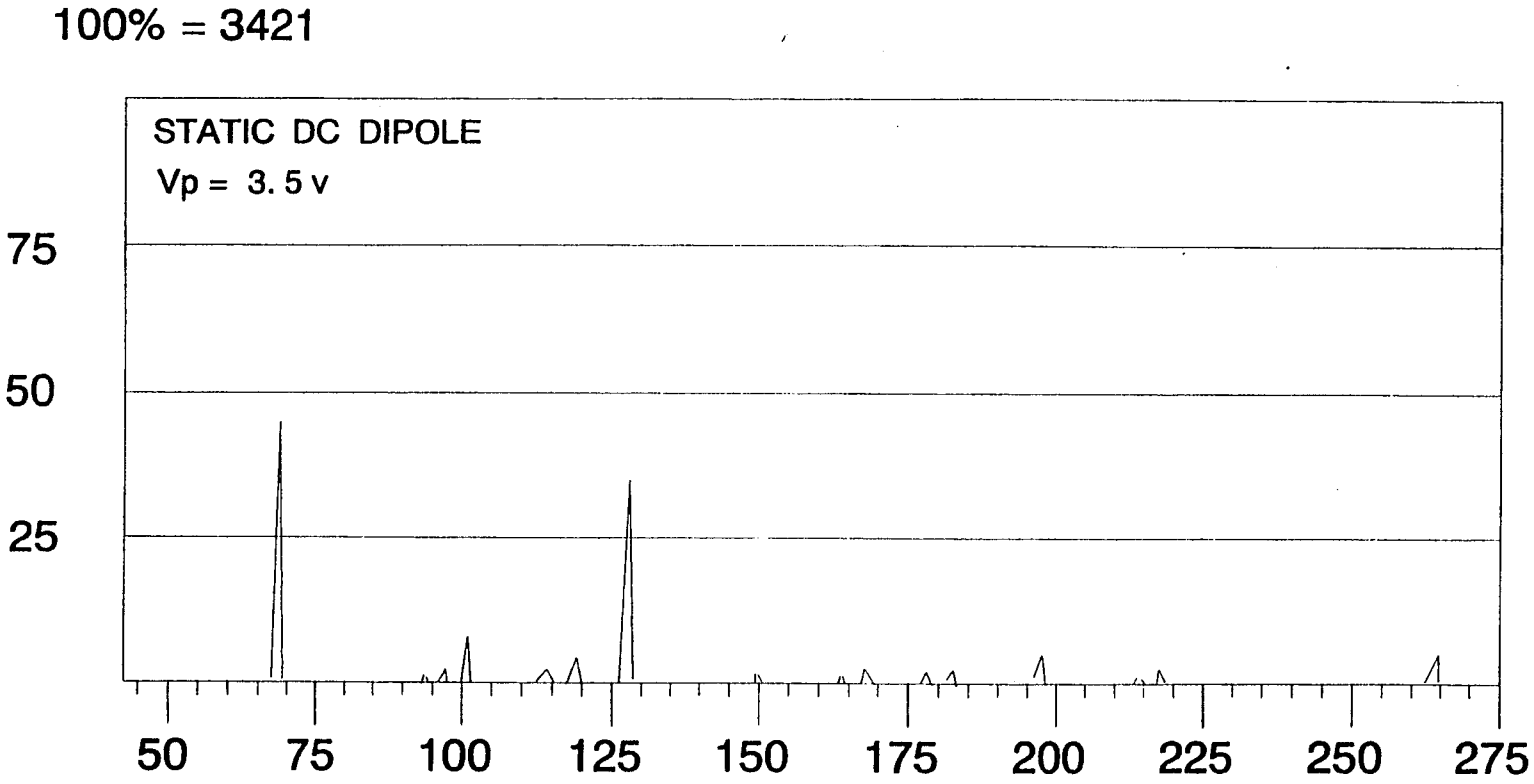
FIG. 5B is a spectrum of PTFBA in a Varian QIT without AC dipole field superposition but with a DC voltage applied to the end cap equal to 3.5 volts.

In our experiments, we have also obtained data for the configuration which applied a fixed DC to one end cap with the impedances 5 and 6 shorted. FIG. 5A shows the data so obtained for the same conditions with PTFBA with the DC voltage applied to the end cap equal to 2.0 volts. Note that the signal intensity for all masses in FIG. 5A are about the same as in FIG. 2. FIG. 5B shows the data for the experiment with a DC applied to the end cap with $V_p$=3.5 V. The lower mass signal insensitivities, e.g. mass 69 in FIG. 5B are almost the same as that in FIG. 2, but the higher mass signal intensities, e.g., mass 264, in FIG. 5B, are much less intense than that in FIG. 2 due to ejection of higher mass ions.

The amplitude of the preferred AC dipole field for the Varian Saturn QIT at maximizing sensitivity is about 2–3% of the amplitude of the trapping field. Adding about 1% monopole field results in further improvement. For the positive ion selection, the phase of the dipole field applied to the multiplier end cap 2B is preferably in phase with the trapping field, and the end cap 2A is preferably out of phase. Also, for positive ions, the monopole field is preferably applied to the end cap 2A and is preferably out of phase with the trapping field and end cap 2B is grounded if monopole field alone is formed.

The values of the lumped resistors, capacitor and inductor for the Varian Saturn QIT of FIG. 1C for the results of FIG. 3 were:

$$R_1 = R_2 = 0$$

$$L = 74\mu H \text{ and } C = 670\ pf, \text{ where } X_1 = 2\pi fL \text{ and } X_2 = \frac{1}{2\pi fC}$$

These values depend on the spacing and are considerably different for different equipment. For these reasons the resistors $R_1$, $R_2$, $X_1$ and $X_2$ preferably are adjustable or include a variable portion.

$X_2$ is a capacitive reactance and $X_1$ is an inductive reactance. We have determined that we get slightly better sensitivity if the reactance $|X_2| \neq |X_1|$. However, the sensitivity data for the condition $|X_2| = |X_1|$ is still improved from the prior art.

The invention herein has been described with respect to the specific drawings. It is not our intention to limit our invention to any specific embodiment, but the scope of our invention should be determined by our claims.

What is claimed is:

1. In a method for improving the sensitivity of a quadrupole ion trap (QIT) spectrometer, said QIT having a ring electrode, a pair of end caps, an RF trapping voltage source having an RF trapping frequency $W_0$ and an amplitude V, and means for changing the trapping RF amplitude V as a function of time, including the steps of:

(a) applying said RF trapping voltage V to said ring electrode at RF frequency $W_0$;

(b) providing ions of a sample in said QIT;

(c) modifying the field within said QIT so that said field is not a pure quadrupole field;

(d) scanning the amplitude of the trapping voltage;

(e) detecting ions being ejected from said QIT;

(f) creating a mass spectrum of said sample by correlating the instantaneous amplitude of said trapping voltage with the number of ions detected, the improved method comprising, wherein said step (c) of modifying the field within said QIT so that said field is not a pure quadrupole field includes superimposing an AC field on said quadrupole field which is a lower order than a quadrupole field.

2. The method of claim 1 wherein said superimposed lower order field is an AC dipole field.

3. The method of claim 2 wherein said AC dipole field is created by introducing equal magnitude but opposite phase transfer functions of $G_1(t)$ and $G_2(t)$.

4. The method of claim 1 wherein said superimposed lower order field is a AC monopole field.

5. The method of claim 4 wherein said AC monopole is created by introducing unequal impedances between said pair of end caps to common return.

6. The method of claim 4 wherein said AC monopole field is created by introducing unequal impedances between said pair of ends caps to common return.

7. The method of claim 4 wherein said AC monopole is created by introducing $G_1 \neq G_2$ where $G_1$ or $G_2$ equals zero.

8. The method of claim 1, wherein said superimposed lower order field is a combination of an AC monopole field and an AC dipole field.

9. The method of claim 8 wherein said AC superimposed monopole and dipole fields are created by introducing unequal impedances between said pair of end caps to common return.

10. The method of claim 1 wherein the step of modifying the field within said QIT includes the step of switching said superimposed lower order AC field on/-off as a function of time.

11. The method of claim 2, wherein AC dipole field is created by introducing unequal impedances between said pair of end caps to common return.

12. The method of claim 11 wherein said impedance between one end cap to common is capacitively tuned and the impedance between the other end cap to common is inductively tuned.

13. The method of claim 11 wherein said unequal impedance between said end caps and common can be switched at selected time to preferentially detect positive ions in one connection and negative ions in a second connection.

14. The method of claim 11 wherein said end caps also supply a supplementary excitation to said QIT, said end caps being coupled together through a center tapped secondary of a transformer and wherein said transformer couples a supplementary excitation source at a frequency $W_2$, where $W_2 \neq W_0$, to said end caps.

15. The method of claim 11 wherein said impedances between said end caps and common return are non-constant as a function of time.

16. In a QIT having a shaped ring electrode substantially enclosing a volume except for top and bottom openings, a pair of end cap electrodes enclosing the top and bottom of said volume, means to develop a quadrupole trapping field potential for retaining ions in said volume by applying voltages to said ring electrode and to said end cap electrodes, said voltage being applied to said ring electrode including a fixed RF frequency $\omega_0$, an ion detector external to said volume and adjacent one of said end caps which end cap is perforated for passing ions from said volume to said ion detector, and QIT parameter scanning apparatus to provide an indication of a scanned parameter versus the number of ions detected by said detector, the improvement comprising, means for modifying the potential field within said volume so that said field in said volume is not a pure quadrupole, said means including means to electrically superimpose a lower order AC field on said quadrupole field, whereby said lower order field is less than a third order.

17. The apparatus of claim 16 wherein said means to electrically superimpose a lower order field includes, a first and second lumped impedance, said first lumped impedance being $R_1+j\,X_1$ connected in circuit between one of said end caps and a common potential point, said second lumped impedance being $R_2+j\,X_2$ connected in circuit between the other of said end caps and said common potential point, whereby the reactance component $X_1$ of said first lumped impedance is of opposite sign from the reactance component $X_2$ of said second lumped impedance.

18. The apparatus of claim 17 wherein $$|R_1+j\,X_1| \neq |R_2-j\,X_2|.$$

19. The apparatus of claim 17 wherein $$|X_1| = |X_2|.$$

20. The apparatus of claim 17 including a supplementary excitation source $W_2$, and wherein said first lumped impedance is coupled to said second lumped impedance through said secondary of a transformer and wherein the primary of said transformer is connected to said supplementary excitation source $W_2$.

21. The apparatus of claim 20 wherein the secondary winding has a center tap and wherein said center tap is connected to said common point.

22. The apparatus of claim 17 including a double pole double throw switch which is connected in circuit between said end caps and said impedances, wherein said switch can interchange the connections of said impedances and end caps between positions of said switch to preferentially detect positive ions in one position and negative ions in the other position.

23. The apparatus of claim 16 including means to superimpose a monopole field upon said quadrupole.

24. The apparatus of claim 23 wherein the value of one of said lumped impedance is zero.

25. The apparatus of claim 16 includes means to control the coefficients A and B in the equation defining the voltage in the z direction in the QIT wherein said voltage is:

$$v_z - A\cos(W_0t+\theta_0) + Bz\cos(W_0t+\theta_1) + Cz^2\cos(W_0t+\theta_2).$$

* * * * *